United States Patent [19]

Caccamisi

[11] 4,248,513

[45] Feb. 3, 1981

[54] APPARATUS FOR DEVELOPING FILM

[76] Inventor: Michael V. Caccamisi, Rte. 2 - Box 698, Garland, Tex. 75040

[21] Appl. No.: 66,170

[22] Filed: Aug. 13, 1979

[51] Int. Cl.[3] ..... G03D 3/04

[52] U.S. Cl. ..... 354/299; 354/328; 354/331

[58] Field of Search ..... 354/299, 300, 315, 324, 354/326, 328, 331, 337; 366/166; 134/64 P, 122 P, 102

[56] References Cited

U.S. PATENT DOCUMENTS

| | | | |
|---|---|---|---|
| 1,074,572 | 9/1913 | Norton | 354/328 |
| 2,892,394 | 6/1959 | Hixon et al. | 354/328 |
| 2,902,914 | 9/1959 | Dye et al. | 354/326 |
| 2,925,767 | 2/1960 | Hixon et al. | 354/299 |
| 3,077,155 | 2/1963 | Maddock et al. | 354/326 |
| 3,349,688 | 10/1967 | Buechner | 354/299 |
| 3,470,818 | 10/1969 | Buechner | 354/299 |
| 3,613,547 | 11/1971 | Snarr | 354/299 |
| 3,852,793 | 12/1974 | McClintock | 354/299 |
| 3,890,629 | 6/1975 | Huss | 354/299 |
| 4,001,855 | 1/1977 | Wilhelm | 134/64 P |

*Primary Examiner*—Joseph W. Hartary
*Assistant Examiner*—Alan Mathews
*Attorney, Agent, or Firm*—Thomas L. Cantrell; Joseph H. Schley

[57] ABSTRACT

Disclosed is an apparatus for organizing and simplifying the development of photographic film. It includes a housing containing a tank for a constant temperature bath, which is provided with a heater and an air agitation line. Several narrow developing tanks for chemicals and rinses are suspended in the bath tank, and each is supplied with an air agitation line. Access to the developing tanks is provided through slots in the top of the housing. An equipment compartment is provided within the housing to accommodate an air pump, an air distribution manifold, bath heater, a timer control switch and the like. Preferably, a drying compartment is also provided in the housing, containing a fan type dryer. Access to the drying compartment is provided through a narrow slot in the top of the housing. Film to be developed is immersed sequentially in the developing tanks (and the dryer) on plates having film gripping clips thereon.

12 Claims, 4 Drawing Figures

APPARATUS FOR DEVELOPING FILM

BACKGROUND OF THE INVENTION

Many people prefer to develop their own photographic films in personal darkrooms rather than utilizing the services of commercial film developing houses. The developing equipment employed by hobbyists and other small-scale film developers is typically rather crude, generally consisting of a series of shallow pans or trays, and film holders or tongs for manipulating the film through the various liquid chemicals and rinses involved in its development. Such equipment must generally be manipulated under conditions of complete darkness and is clumsy to use under those conditions. In addition, the temperature of the developing chemicals and rinses plays an important part in the final quality of the developed film, and obtaining and maintaining the desired temperatures in the trays is difficult.

It is also typical for a hobbyist darkroom to be located in a closet, bathroom, storeroom, or some other room having a primary use other than as a darkroom. This means that between uses, the developing paraphernalia must be stored, and the commonly used trays, etc., are no more convenient to store than kitchen utensils, which they closely resemble.

Large-scale film developers have available to them special equipment for facilitating the development of film, such as that shown in U.S. Pat. Nos. 2,892,394; 2,925,767; 3,349,688; 3,470,810 and 3,890,629; but such equipment is generally too eleborate and expensive to be of interest or utility to photographic hobbyists.

SUMMARY OF THE INVENTION

In accordance with the present invention, there is provided a simple, compact, and effective device for facilitating the developing of photographic film which is particularly adapted to the needs of hobbyists and other small-scale film developers. By reason of its compactness, it is easy to store between uses, a convenience for those who must use closets, bathrooms, etc., as temporary darkrooms. Its arrangement is such that temperature control and maintenance of chemical and rinse baths is simple and effective, and manipulation of the film through the unit is easy.

The developer of the invention comprises a housing, the interior of which is divided into at least two, and preferably three compartments. The primary compartment is a tank which serves as a constant temperature bath, and is adapted to hold a substantial quantity of water or another suitable liquid. Suspended from mounting means within the tank are a series of narrow open-topped rectangular tanks adapted to hold chemical solutions and rinses involved in the photographic developing process. These are arranged parallel to one another to facilitate manipulation of film from one tank to another under conditions of complete darkness. Access to the chemical and rinse tanks from outside the housing is provided through narrow slots provided in the housing.

The constant temperature bath tank is provided with heating means, such as an electrical immersion heater element, and with an air agitation line. Each of the chemical and rinse tanks is provided with an air agitation line.

The second compartment within the housing, preferably at one end thereof, is an equipment compartment. It contains the portion of the immersion heater which is not immersed in the constant temperature bath, a thermostatic control for the heater, an air pump, an air distribution manifold, air delivery lines extending from the manifold to the several air agitation lines, a timer, and various control switches.

The third compartment within the housing, which may be omitted if desired, is a drying compartment, and is preferably located at the end of the unit opposite the equipment compartment. Access to the drying compartment is provided through a slot in the top of the housing, which slot is preferably aligned parallel with the access slots for the developing tanks, again to simplify film manipulation in complete darkness. The compartment is provided with a fan and heating element type dryer positioned to direct a stream of warmed air onto film placed in the dryer.

Film mounting plates, with film gripping clips on one or both surfaces thereof, are provided for carrying film. The plates are sequentially immersed in one developing tank and then the next, and are finally placed in the drying compartment in the course of developing film.

In use, the bath is filled with sufficient water so that it surrounds the major portion of each of the developing tanks. The developing tanks are filled with the appropriate chemical solutions and rinses, the order preferably being with the first chemical employed in a developing process being placed in the tank most remote from the dryer and with the last treatment liquid (usually a rinse) being placed in the tank nearest the dryer, with the intervening tanks containing the other chemical solutions and rinses in order of use progressing toward the dryer.

The heater is turned on, under control of the thermostat, and begins to bring the constant temperature bath and the liquids in the developing tanks to the desired temperature. The heating of the water in the bath is direct, and the heating of the developing tank liquids is indirect, through the water of the bath.

The air pump is turned on, and air is pumped to the air agitation lines of the constant temperature bath and the several developing tanks. Air bubbling up through the bath and the tanks helps distribute the heat from the heater uniformly therethrough, and the agitation of the chemicals and rinses assures thorough contact with the film immersed in them, as well as keeping those chemicals which tend to settle or concentrate in the bottom of their respective tanks well distributed and mixed with their solvents.

When the developing solutions and rinses have come to the desired temperature, the dryer is turned on. Film to be developed is clipped onto a mounting plate, and the plate is immersed sequentially in each of the developing and rinse tanks and is finally inserted into the dryer. The residence time in each tank and the dryer is controlled or monitored with the aid of the timer.

From the foregoing, it can be seen that a principal object of the present invention is the provision of a photo-developing apparatus which is compact, simple in construction, easy to use in the dark, superior in its temperature control, and easy to store, all toward the end of simplifying photo developing for hobbyists and other small scale film developers.

The manner in which this object, together with other objects and purposes, are attained may best be understood by a consideration of the detailed description which follows, together with the accompanying drawings.

DESCRIPTION OF THE PREFERRED EMBODIMENTS

Figure 1:
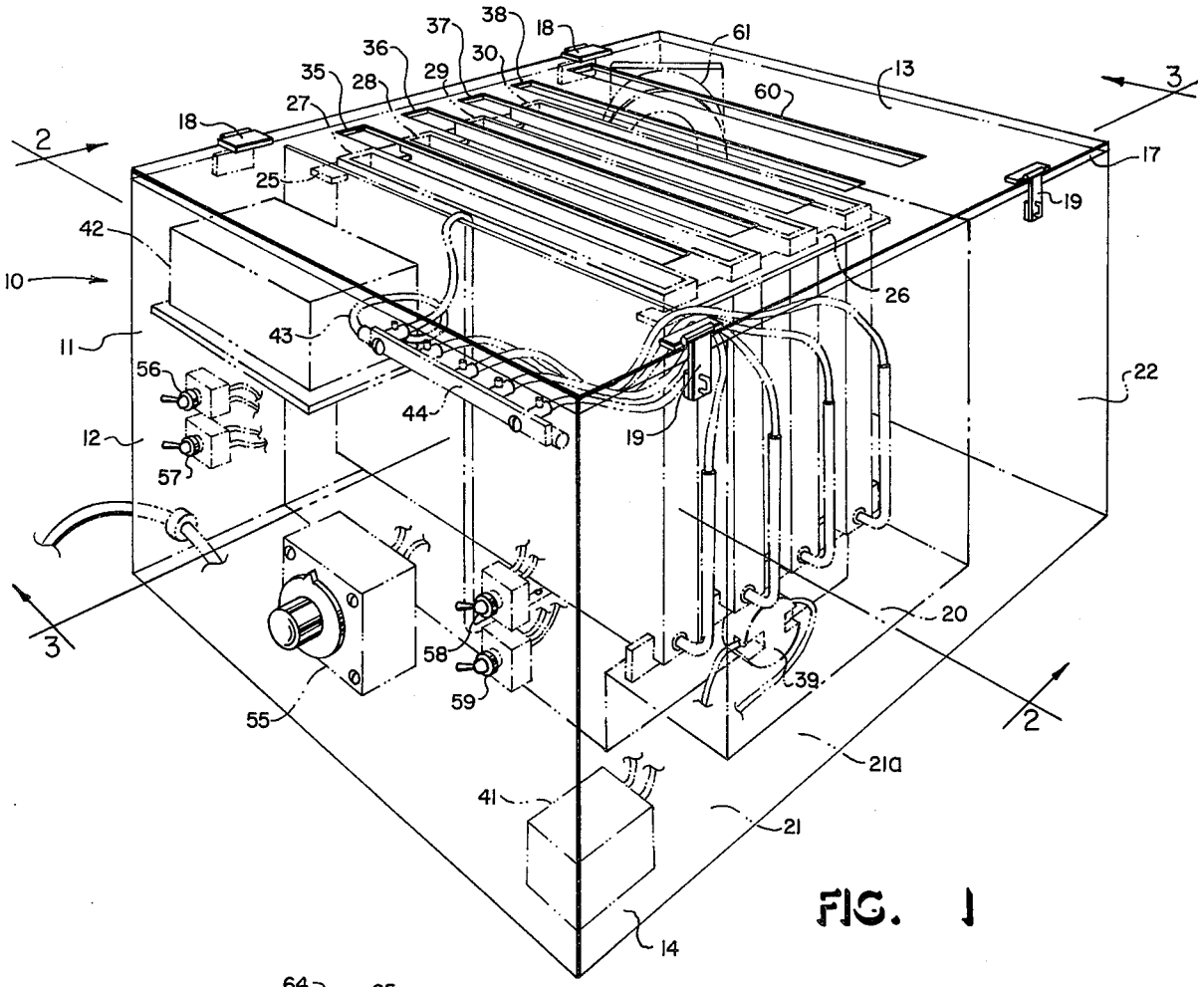
FIG. 1 is a somewhat diagrammatic perspective view of a film developing apparatus constructed in accordance with the invention.

In the drawings the apparatus of the invention is designated generally as 10. It includes a box-like housing 11, having end walls 12, 13, side walls 14, 15, bottom wall 16, and top wall or lid 17. Lid 17 is preferably mounted on the balance of housing 11 so that it may be opened to give access to the interior of the housing for adding and removing liquids, cleaning, and repair of mechanical and electrical parts. Thus it is provided with hinges 18 and latches 19. In the embodiment shown in the drawings, housing 11 is shown as formed of a transparent material, such as polymethylmethacrylate, but it may be made of any suitable material.

The space within housing 11 is divided into three compartments, a constant temperature bath tank 20, an equipment compartment 21, and a dryer compartment 22, with tank 20 occupying the central portion of the housing, and the equipment and dryer compartments being at opposite ends of the housing. The division of the space within the housing is achieved by means of partitions 23 and 24, although other forms of construction may be used. Part of equipment compartment 21 extends under one side of tank 20, as at 21*a*.

Two tank mounting brackets 25, 26, are provided at the top of bath tank 20 on opposite sides thereof. Removably suspended on the brackets are four developing tanks, 27, 28, 29 and 30. The tanks are shaped to receive film to be developed. Thus they are narrow in width, relatively deep, and rectangular in elevation.

The apparatus shown in the drawings is designed for use in a developing system in which four stages are involved, all of which are carried out at the same temperature. (Typically these stages are (1) contact with developer chemical, (2) water rinse, (3) contact with fixer chemical and (4) water rinse.) Hence the apparatus has a single constant temperature bath, and four developing tanks. Units for photographic developing processes having different numbers of stages may be provided with the appropriate number of developing tanks. Similarly, a unit for use in a process in which the stages are carried out at different temperatures may be provided with several different constant temperature baths, each with its own heater and control.

Each of the developing tanks is provided with an air agitation line 31 which runs along the bottom of its tank and is provided with a series of holes or performations 32. In addition, the constant temperature bath 20 is provided with a similar air agitation line 33, having perforations 34 therealong. It is positioned to run along the bottom of tank 20 so that it crosses under each of the developing tanks.

Access to each of the developing tanks, 27, 28, 29 30 is provided by means of slots 35, 36 37, 38, formed in housing top 13, one slot being aligned with each tank. Both the slots and tanks are arranged in a parallel array so that film can be manipulated from one to another easily in darkness.

A heater 39 of the electrical immersion type is positioned in the equipment compartment, in portion 21*a* thereof. The U-shaped immersion element 40 of heater 39 extends into constant temperature bath 20 in the lower portion thereof beneath the developing tanks. A thermostat control 41 for the heater is positioned in the equipment compartment 21. Control 41 may have a sensing element (not shown) penetrating into tank 20.

An air pump 42 of the kind commonly employed in aquarium tanks is mounted in the equipment compartment. The compressed air output from the pump is led through line 43 to an air distribution manifold 44, also mounted in the equipment compartment. Manifold 44 has five output valves 45, 46, 47, 48 and 49, each of which may be adjusted to set the air flow at the desired rate, and to balance it among the various lines. To each of the valves is connected an air delivery line leading to one of the air agitation lines in the several tanks. Thus line 50 leads from valve 45 to air agitator line 33 in the constant temperature bath 20, line 51 leads from valve 46 to the air agitation line in tank 30, and so forth with lines 52, 53 and 54. The lines to the removable developing tanks preferably have sufficient slack in them to permit the tanks to be readily lifted out of the constant temperature bath. For complete removal of a tank, a line can be temporarily disconnected from the air agitation line of the tank.

In addition to the equipment already discussed, equipment compartment 21 has a timer 55 mounted therein on wall 12. Wall 12 also carries switches 56, 57, 58 and 59 for actuating the air pump, the heater, the timer, and the dryer to be discussed below.

Dryer compartment 22 has a slot 60 formed in top wall 13 to permit wet developed film to be lowered into the compartment. An electrical dryer 61 of the heating-element-and-fan type is mounted in dryer compartment 22 in position to direct a current of warm air onto and over a film lowered through slot 60.

Figure 2:
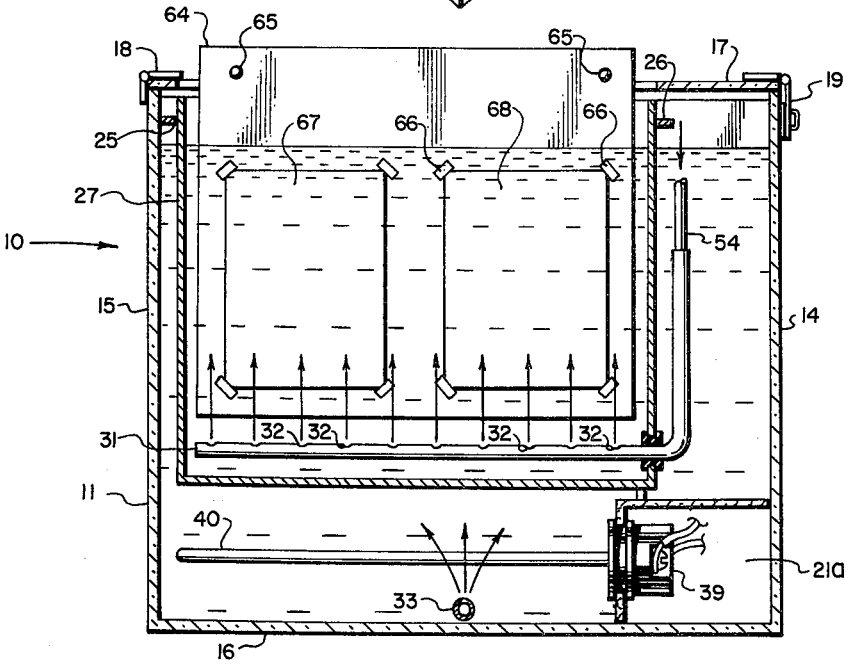
FIG. 2 is cross sectional end elevational view, the section being taken on line 2—2 of FIG. 1.
Figure 3:
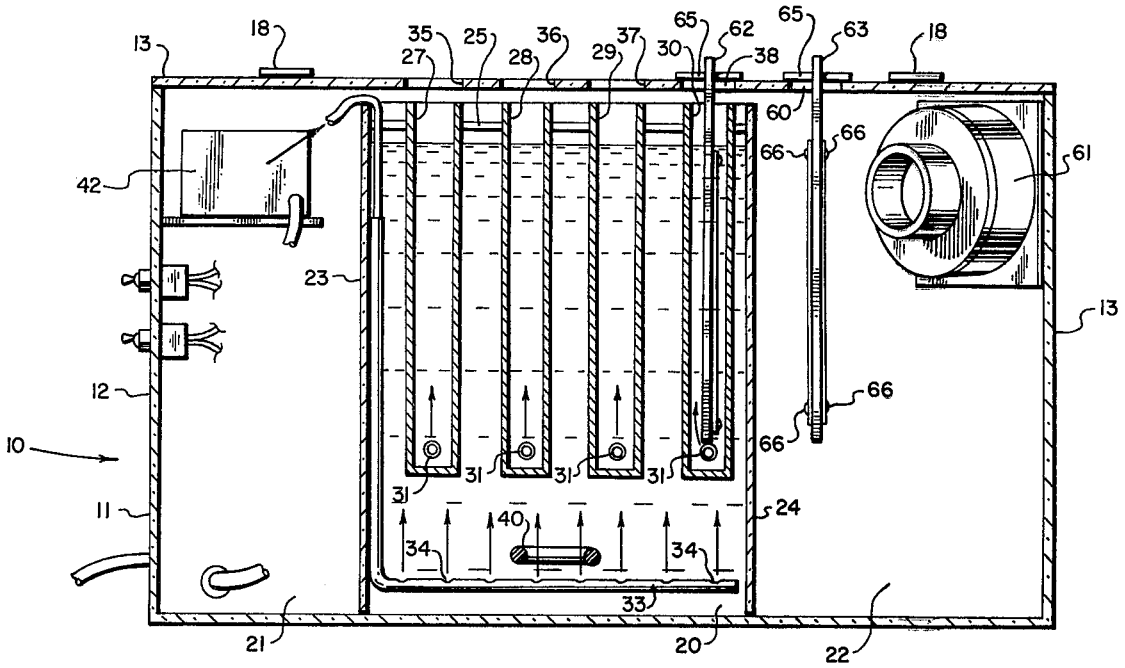
FIG. 3 is a cross sectional side elevational view, the section being taken on line 3—3 of FIG. 1.
Figure 4:
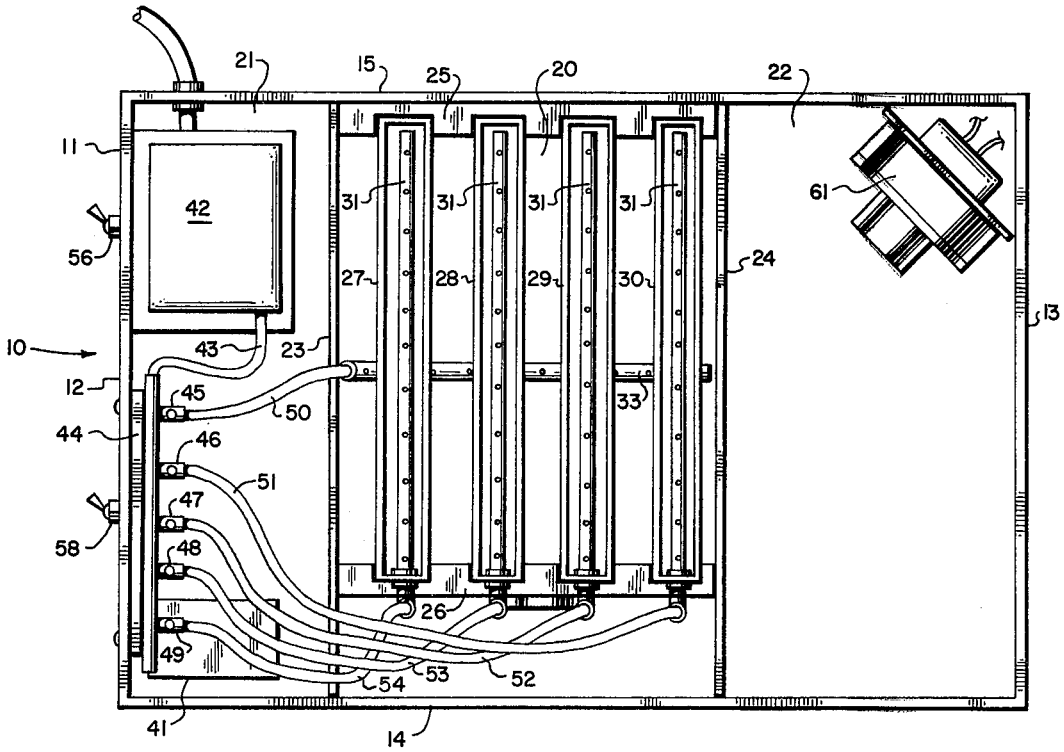
FIG. 4 is a top plan view, drawn with the top of the housing removed.

Film being developed may be manipulated from tank to tank through the unit with tongs if desired, but it is much preferred to employ film mounting plates such as 62, 63, and 64 in accordance with the invention. In the drawings plates 62 and 63 are shown in FIG. 3 as immersed in tank 30 and dryer compartment 22 respectively, while plate 64 is shown in FIG. 2 as immersed in tank 27. From these FIGS. it can be seen that the plates are relatively thin and are rectangular. They are proportioned to fit through the slots in the top of the housing, and into the developing tanks and dryer compartment. Near their top edges pins 65 are provided to support them at an appropriate position in the tanks and dryer.

Each developing plate has film gripping means or tabs 66 distributed on at least one, and preferably both, surfaces thereof. These tabs are positioned to grip the corners of various standard sized films. The plate shown in FIG. 2 is shown carrying two films, 67, 68.

In use, after the constant temperature bath and the developing tanks have been brought to the desired temperature by operation of the heater and the air agitation system, films to be developed are mounted on the developing plates, and the plates are moved from tank to tank through the unit and are finally placed in the dryer. The residence time in each tank may be monitored and controlled by use of the timer. If a plate has film mounted on both surfaces or sides, it may be desirable to turn it after a period of residence in the dryer to expose the film on both sides directly to the current of warm air. When the developing process is one in which the residence time in each stage is uniform, it is quite convenient to process plates through the unit serially, with one plate being removed from the dryer at approximately the same time as another is being placed in the first developing tank. In this way, a substantial stock of film may be developed quite quickly.

In the foregoing discussion, the term "film" has been used quite broadly and generically, to include negative and positive film per se as well as print paper, glass or metal plates, or the like, and other thin flat photosensitive elements.

I claim:

1. Apparatus for developing photographic film and the like comprising:

a housing having an openable top;

a constant temperature bath tank adapted to contain a non-flowing bath of liquid within the housing;

at least one upwardly open developing tank removably mounted in said constant temperature bath tank, said developing tank having a perforated air agitation line therein;

a slot in the top of said housing aligned with said developing tank giving access thereto for insertion and removal of film to be developed;

an equipment compartment within said housing;

an air pump in said equipment compartment; and flexible air delivery means in said equipment compartment for delivering air from said air pump to said air agitation line and through the perforations thereof into said developing tank to agitate liquid therein, said flexible air delivery means being of a length sufficient to permit ready removal of said developing tank from said constant temperature bath tank without the necessity of disconnecting said means from said developing tank air agitation line below the liquid level in said constant temperature bath tank.

2. Apparatus in accordance with claim 1 in which a plurality of developing tanks are positioned in said constant temperature bath tank, in which a plurality of slots are provided in said housing one in alignment with each developing tank and in which said developing tanks and slots are oriented generally parallel with one another to facilitate transfer of film from tank to tank under conditions of darkness.

3. Apparatus for developing photographic film and the like comprising:

a housing;

a constant temperature bath tank within the housing;

at least one upwardly open developing tank mounted in said constant temperature bath tank, said developing tank having a perforated air agitation line therein;

a slot in said housing aligned with said developing tank giving access thereto for insertion and removal of film to be developed;

an equipment compartment within said housing;

an air pump in said equipment compartment;

air delivery means in said equipment compartment for delivering air from said air pump to said air agitation line, and through the perforations thereof into said developing tank to agitate liquid therein;

a dryer compartment within said housing;

a second slot in said housing giving access to said dryer compartment for insertion and removal of film; and dryer means in said dryer compartment for generating and directing a current of warm air toward a film inserted into said dryer compartment through said second slot.

4. Apparatus in accordance with claim 3 in which said slots are oriented generally parallel with each other to facilitate transfer of film from developing tank to dryer compartment under conditions of darkness.

5. Apparatus in accordance with claim 1 and further comprising heating means in said constant temperature bath tank.

6. Apparatus in accordance with claim 5 and further comprising control means for said heating means positioned in said equipment compartment.

7. Apparatus in accordance with claim 1 and further comprising a timer positioned in said equipment compartment, for providing timing information to one processing film through said apparatus under conditions of darkness.

8. Apparatus in accordance with claim 1 and further comprising a substantially flat film mounting plate having film gripping clamps distributed on at least one surface thereof, said plate being proportioned for removable insertion through said slot into said developing tank.

9. Apparatus in accordance with claim 1 in which said air delivery means comprise:

a manifold connected to receive air from said air pump;

a plurality of air delivery lines connected to said manifold, one of said air delivery lines being connected to each of said air agitation lines;

and valve means for adjusting the rate of air flow in each of said air delivery lines.

10. Apparatus in accordance with claim 1 and further comprising a perforated air agitation line in said constant temperature bath tank extending under said developing tank, said constant temperature bath tank air agitation line receiving air from said pump through said air delivery means and delivering it through the perforations thereof into said constant temperature bath to agitate liquid therein.

11. Apparatus in accordance with claim 1 in which the air agitation line of said developing tank extends along the bottom of the developing tank.

12. Apparatus for developing photographic film and the like through development processes which require temporally sequential immersion into various chemical solutions and rinses, said apparatus comprising:

a compartmentalized housing having walls defining said housing, a housing lid for a top wall, an equipment compartment, a dryer compartment, and a constant temperature bath tank;

an array of parallel developing tanks for containing said chemical solutions and rinses, each extending vertically into said constant temperature bath tank from the top thereof;

an array of slots through said housing lid, said slots aligned with said developing tanks and said dryer compartment whereby photographic film and the like are introduceable through said housing lid into said chemical solutions, said rinses and said dryer compartment;

a heating element positioned within said constant temperature bath tank and beneath said developing tanks;

a thermostat to control the heating elements within said constant temperature bath tank;

an air pump positioned within said equipment compartment;

air agitation lines positioned at the bottom of said developing tanks;

an air delivery means running from said pump to said air agitation lines, said air delivery means comprising:

a manifold connected to receive air from said air pump; and a plurality of air delivery lines connected to said manifold, one of said delivery lines being connected to each of said air agitation lines;

perforations in said air agitation lines whereby air is dischargeable from said air agitation lines to form bubbles which agitate the liquid chemical solution or rinse within that said developing tank as the bubbles ascend therethrough;

an electrical dryer in said dryer compartment; and an electricity delivery means for supplying power to said heating element, said air pump and said electrical dryer.

* * * * *